US009237636B1

(12) United States Patent
Xiong et al.

(10) Patent No.: US 9,237,636 B1
(45) Date of Patent: Jan. 12, 2016

(54) SELF-CLAMPED RESONANT FILAMENT HEATING CIRCUIT

(71) Applicant: Universal Lighting Technologies, Inc., Madison, AL (US)

(72) Inventors: Wei Xiong, Madison, AL (US); Brandon Dyer, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 0 days.

(21) Appl. No.: 14/681,632

(22) Filed: Apr. 8, 2015

Related U.S. Application Data

(60) Provisional application No. 61/991,960, filed on May 12, 2014.

(51) Int. Cl.
*H05B 37/00* (2006.01)
*H05B 41/295* (2006.01)
*H01J 61/52* (2006.01)

(52) U.S. Cl.
CPC ..... *H05B 41/295* (2013.01); *H01J 61/526* (2013.01)

(58) Field of Classification Search
CPC .... B05B 41/295; B05B 41/042; H01J 41/042
USPC ..... 315/106, 309
See application file for complete search history.

(56) References Cited

U.S. PATENT DOCUMENTS

| | | | | |
|---|---|---|---|---|
| 5,841,240 | A | 11/1998 | Beij et al. | |
| 5,920,155 | A | 7/1999 | Kanda et al. | |
| 5,977,725 | A | 11/1999 | Miyazaki et al. | |
| 6,696,791 | B2 | 2/2004 | Raiser et al. | |
| 7,187,132 | B2 | 3/2007 | Bakre | |
| 8,115,421 | B2 | 2/2012 | Mishima et al. | |
| 8,847,512 | B1 * | 9/2014 | Xiong | H05B 41/295 315/244 |
| 2002/0017878 | A1 * | 2/2002 | Hakuta | H05B 41/2827 315/291 |
| 2010/0060180 | A1 * | 3/2010 | Muehlschlegel | H05B 41/2881 315/224 |
| 2014/0152179 | A1 * | 6/2014 | Wang | H01J 61/526 315/102 |

* cited by examiner

*Primary Examiner* — Don Le
(74) *Attorney, Agent, or Firm* — Patterson Intellectual Property Law, P.C.; Mark J. Patterson; Gary L. Montle

(57) ABSTRACT

An electronic ballast is provided with a filament heating circuit having a Q factor clamped at a certain range of preheat frequency. An inverter circuit includes a pair of switches coupled between positive and negative terminals of a power supply, which oscillate at an operating frequency and generate an output voltage. A main resonant tank is coupled between an inverter output and the negative power supply terminal. A filament heating resonant tank includes a primary winding of a filament heating transformer coupled on a first end in series with the resonant capacitor, first and second capacitors coupled in series between the second end of the primary winding and the negative power supply terminal. A clamping circuit coupled to the second capacitor during a preheat mode of operation clamps an amplitude of the voltage across the primary winding to an amplitude of the input voltage from the power supply.

20 Claims, 5 Drawing Sheets

SELF-CLAMPED RESONANT FILAMENT HEATING CIRCUIT

CROSS-REFERENCES TO RELATED APPLICATIONS

This application claims benefit of U.S. Provisional Patent Application No. 61/991,960, dated May 12, 2014, and which is hereby incorporated by reference.

A portion of the invention of this patent document contains material that is subject to copyright protection. The copyright owner has no objection to the reproduction of the patent document or the patent invention, as it appears in the U.S. Patent and Trademark Office patent file or records, but otherwise reserves all copyright rights whatsoever.

BACKGROUND OF THE INVENTION

The present invention relates generally to program start electronic ballasts for powering discharge lamps with filament heating. More particularly, the present invention relates to program start ballasts having a resonant filament heating circuit configured with circuitry to clamp the quality ("Q") factor of the oscillator.

Program start ballasts are known to be very useful for conditions where lights are expected to be frequently turned on and off, as they can properly operate the lamp filaments to generally extend the lamp life. To obtain a longer lamp life a program start ballast has to properly heat the lamp filaments before ignition of the lamp, but after ignition has been achieved further filament heating is unnecessary as long as the lamp current is sufficiently high.

Therefore a filament heating circuit for a program start ballast would desirably have strong filament heating capability, with a constant filament heating output voltage that is substantially insensitive to component variation and to preheat frequency.

It would be further desirable to automatically scale back or disable the filament voltage after ignition of the lamp to improve the efficiency of the total ballast.

It would be even further desirable that the ballast circuitry always operated in an inductive mode rather than capacitive mode to ensure soft switching during the preheat period of the half-bridge inverter that powers the filament heating circuit. In other words, the preheat frequency should be greater than a resonant frequency for the filament heating circuit.

In any case, it would be desirable to provide a filament heating circuit that is relatively simple and of low cost.

Referring to FIG. 1, a ballast 10 for powering one or more lamps 18 may be provided with a voltage driven, series resonant inverter circuit as shown that is known to those of skill in the art as an option to provide these functions. The ballast 10 may include a pair of inverter switches Q1, Q2 driven at a certain frequency (f) by a controller or drive circuit 12 which may generally be an integrated circuit 12. The switches Q1, Q2 convert an input signal from the DC voltage source Vdc into a square wave AC output. The primary winding Tp of filament heating transformer T1 and capacitor C1 in the configuration shown form a resonant tank 14. Secondary windings Ts1, Ts2 are coupled to output terminals 16 for the ballast and used to drive lamp filaments for one or more lamps that may be coupled to the output terminals 16.

Referring now to FIG. 2, an output voltage characteristic of the ballast circuit 10 of FIG. 1 is shown with respect to the switching frequency (f) of the inverter switches Q1, Q2. The output voltage Vout is the voltage across the primary winding Tp of the filament heating transformer T1. The natural resonant frequency associated with the components Tp, C1 of the resonant tank 14 is fres. When the switching frequency (f) approaches or otherwise operates nearby the resonant frequency (fres), such as in this example at the preheat frequency (fpre), the output voltage Vout is large and output power capability is correspondingly large as well. When the switching frequency (f) operates far away from the resonant frequency (fres), such as in this example at the steady-state frequency (fsteady), the output voltage Vout will be quite small. Therefore a filament heating circuit 10 as shown is low cost, has strong preheating capability where the switching frequency (f) is near the resonant frequency (fres), and further can naturally scale back the output voltage Vout in steady state operation where the switching frequency (f) is reduced to (fsteady).

However, this circuit 10 has significant drawbacks as well. The output voltage Vout is undesirably sensitive to variations in the preheat frequency (fpre) and other component variation, as operation of the circuit at the preheat frequency (fpre) is also quite close to the natural resonant frequency (fres) for the circuit 10. Another way of describing this problem is to observe that the quality factor (Q factor) for this circuit 10 and resonant tank 14 is quite large and that small variations in frequency near the resonant frequency result in large variations in the output voltage.

Further, the operating mode of the circuit is capacitive because the preheat frequency (fpre) is less than the natural resonant frequency (fres), and therefore soft switching is not ensured.

BRIEF SUMMARY OF THE INVENTION

Various embodiments of a filament heating circuit for an electronic ballast as disclosed herein produce a constant output voltage in preheat operating conditions and naturally cut back the filament preheat voltage during steady state operation.

In another aspect of the present invention, an output voltage curve is produced having a relatively flat peak around preheat operating frequency, and a resonant frequency that is less than the preheat frequency.

In another aspect, an exemplary filament heating circuit as disclosed herein provides an output voltage that is substantially insensitive to operating frequency and component variation.

In another aspect, an exemplary filament heating circuit as disclosed herein is configured so as to ensure an inductive mode of operation during preheat conditions.

DETAILED DESCRIPTION OF THE INVENTION

Figure 1:
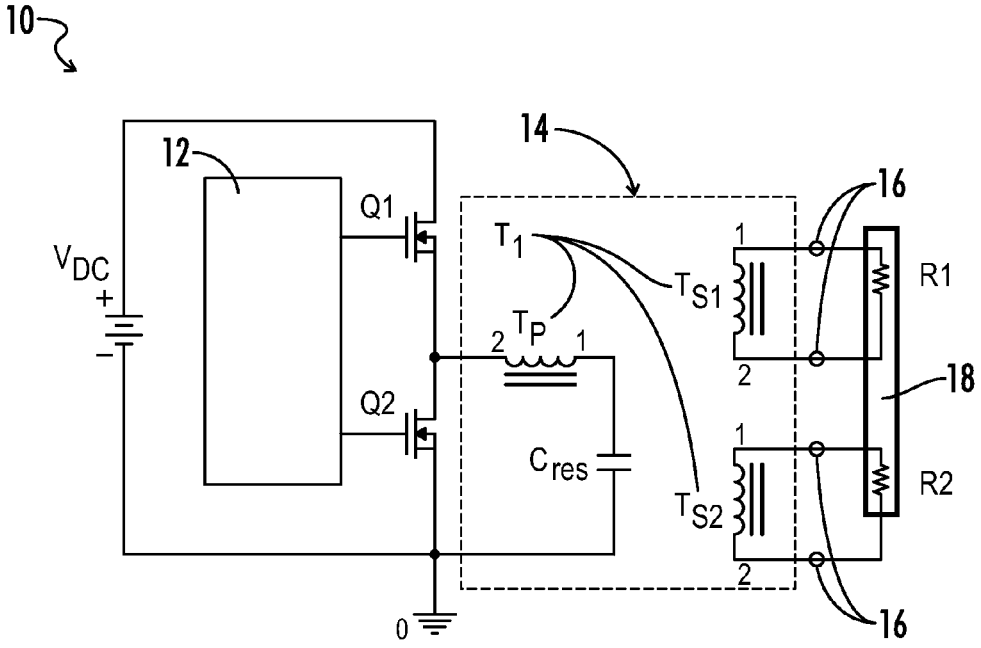
FIG. 1 (PRIOR ART)
FIG. 1 is a circuit diagram showing a voltage driven, series resonant filament heating circuit as previously known in the art.
Figure 2:
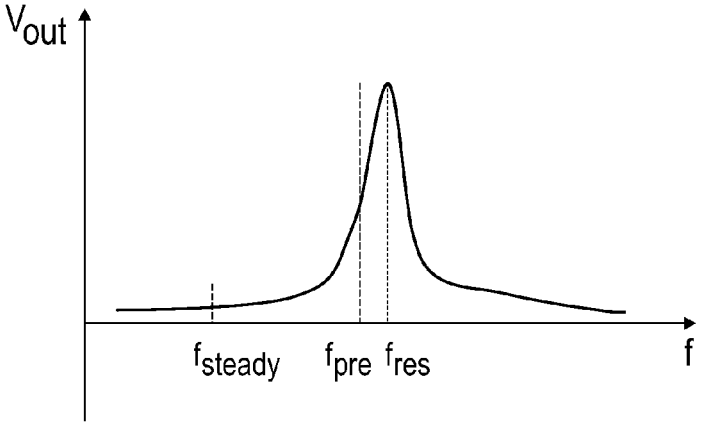
FIG. 2 (PRIOR ART)
FIG. 2 is a graphical diagram representing an output voltage curve of the circuit of FIG. 1 with respect to switching frequency.

Referring generally to FIGS. 3-10, various embodiments of a filament heating circuit for an electronic ballast having a clamped Q factor may be further described herein. Where the various figures may describe embodiments sharing various common elements and features with other embodiments, similar elements and features are given the same reference numerals and redundant description thereof may be omitted below.

Figure 8:
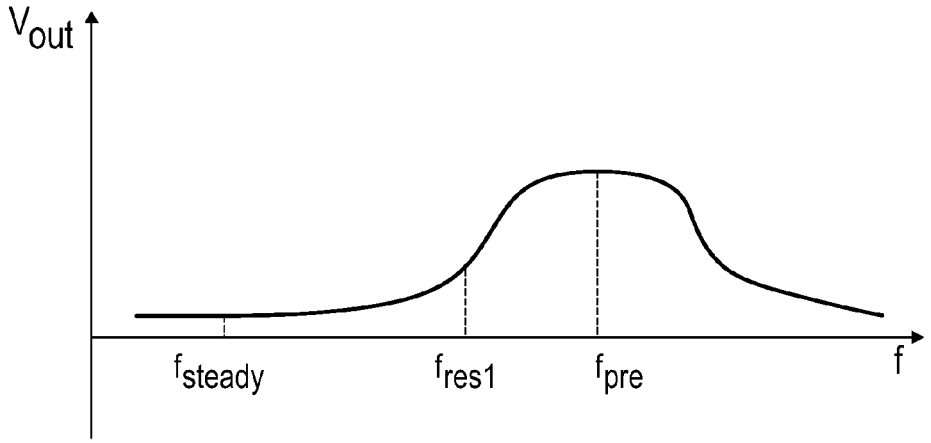
FIG. 8 is a graphical diagram showing a representative output voltage curve for the embodiment of FIG. 3 with respect to switching frequency.

A filament heating circuit for an electronic ballast in accordance with various embodiments of the present invention may be provided to produce an output voltage curve such as shown in FIG. 8, with a relatively flat peak around the preheat frequency (fpre), a resonant frequency (fres1) that is less than the preheat frequency (fpre), and a very low output voltage at the steady state operating frequency (fsteady).

The flat peak around the preheat frequency generally reduces dependence of output voltage variation on the preheat frequency (fpre) and component tolerances, such that the output voltage Vout may be stable, or in other words appear to have a constant value within a certain range of preheat frequency and component values. The flat peak may be obtained through clamping of the Q factor of the filament heating circuit within a given range of the preheat frequency (fpre).

It may be understood by one of skill in the art that the peak is not truly "flat" but that the rate of change is substantially reduced in the vicinity of the preheat frequency such that the output voltage is relatively "stable" with respect to foreseeable fluctuations in frequency or component variation. Therefore, the terms "flat" and "stable" as used herein may refer generally to desirable characteristics of an output voltage curve with respect to switching frequency as would be understood by one of skill in the art.

Providing a resonant frequency (fres1) that is less than the preheat frequency (fpre) may ensure inductive operation within the same range of the preheat frequency (fpre) in which the Q factor is clamped.

A single resonant circuit arrangement generally cannot achieve this preferred output characteristic. However a circuit with multiple Q factors depending on the switching frequency may achieve this desirable output voltage characteristic.

Figure 7:
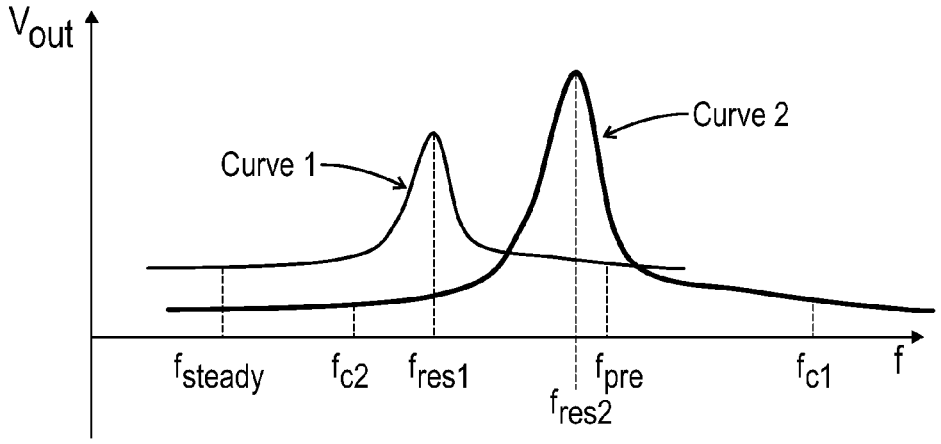
FIG. 7 is a graphical diagram showing output voltage characteristics for the embodiment of FIG. 3 with respect to switching frequency.

Various embodiments of a filament heating circuit 24 as disclosed herein may be configured to generate multiple output voltage curves with respect to switching frequency (f). Referring to FIG. 7, examples of such frequency-voltage relationships are shown as curve 1 and curve 2. Curve 1 represents a first resonant frequency (fres1), and curve 2 represents a second resonant frequency (fres2). The resonant frequency of curve 2 (fres2) is less than the resonant frequency of curve 1 (fres1). In one embodiment, when the filament heating circuit 24 operates in a preheat mode, the output curve is curve 1. Because the preheat frequency (fpre) is greater than the resonant frequency (fres1), the filament heating circuit 20 operates in the inductive mode. The output voltage Vout of curve 1 at a certain range of preheat frequency (fpre) is substantially flat so that the output voltage Vout may have little to no sensitivity to frequency and component variation.

When the filament heating circuit 24 operates in steady state, the output curve shifts to curve 2, which has a much lower output voltage Vout than curve 1 at the steady state switching frequency (fsteady), such that the filament heating voltage Vout is effectively reduced or disabled in the steady-state operating mode.

Therefore, the effective output voltage characteristic for the filament heating circuit 24 appears as in FIG. 8, and looks like the Q factor for the filament heating circuit 24 is clamped over a certain range of preheat frequency.

Figure 3:
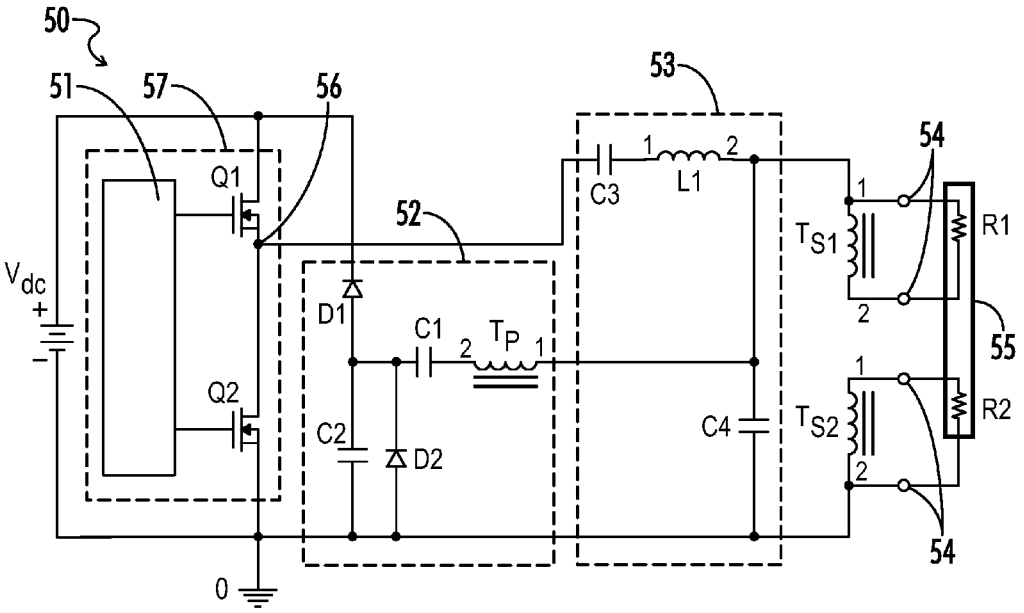
FIG. 3 is a circuit diagram showing one embodiment of a lighting device including a filament heating circuit in accordance with the present invention.

Referring now to FIG. 3, one embodiment of a filament heating circuit 52 for an electronic ballast 50 may be described which is effective to generate the desirable output voltage characteristic previously described and as shown in FIG. 8. The ballast 50 includes a voltage source Vdc which provides input power across positive and negative voltage rails. In one embodiment, the DC voltage source may be a power factor correction circuit or the like as effective to provide a regulated or otherwise fixed DC voltage output. An inverter circuit 57 includes a first switching element Q1 and a second switching element Q2 which are coupled in series across the positive and negative voltage rails in a half-bridge configuration. A controller 51 is configured to produce switch driving signals and operate the switching elements at desired frequencies to produce an output voltage at a node 56 between the switching elements, further defining an inverter output terminal 56.

A resonant tank 53 in the embodiment as shown includes a DC blocking capacitor C3, a resonant inductor L1 and a resonant capacitor C4 coupled in series between the inverter output terminal 56 on a first end, and the negative voltage rail on a second end. In the embodiment as shown, the negative voltage rail further defines a circuit ground. A lighting source 55 may be coupled across the resonant tank output, on a first end being coupled to the node between the resonant inductor L1 and the resonant capacitor C4, and on a second end being coupled to the negative voltage rail.

A filament heating circuit 52 with filament heating resonant tank components as further described herein is coupled in series with the resonant capacitor C4, in various embodiments having the effect of substantially providing soft switching operation of the ballast. The primary winding Tp of a filament heating transformer is electrically coupled on a first end to the node between the resonant inductor L1 and the resonant capacitor C4. A first capacitor C1 is coupled on a first end to the second end of the primary winding Tp of the filament heating transformer. A second capacitor C2 is coupled between the second end of the first capacitor C1 and the negative voltage rail for the ballast 20 (e.g., ground).

A clamping circuit is further coupled to the second capacitor C2 and is effective during a preheat mode of operation to clamp an amplitude of the voltage across the primary winding Tp of the filament heating transformer to an amplitude of the input voltage from the inverter 57. Referring to the embodiment of FIG. 3, a diode D2 is coupled in parallel with the second capacitor C2 to create a DC offset across the second capacitor C2 and force the voltage across the second capacitor C2 to be greater than zero. Another diode D1 is coupled in series with the diode D2 and on a second end to the positive voltage rail for the ballast 57 to clamp the output voltage of the second capacitor C2 and therefore the quality factor (i.e., Q factor) for the filament heating circuit 52 generally.

When the diode D1 is non-conductive, the output curve for the circuit 10 is curve 2 as shown in FIG. 7, and the resonant frequency (fres2) for the resonant tank is:

$$fres=1/(2\Pi\sqrt{(L1\times Ceq)}),$$

where L1 is the inductance of the primary winding Tp of the filament heating transformer T1, and Ceq is the equivalent capacitance of C1 and C2 in series, i.e., $$Ceq=(C1\times C2)/(C1+C2).$$

Figure 4:
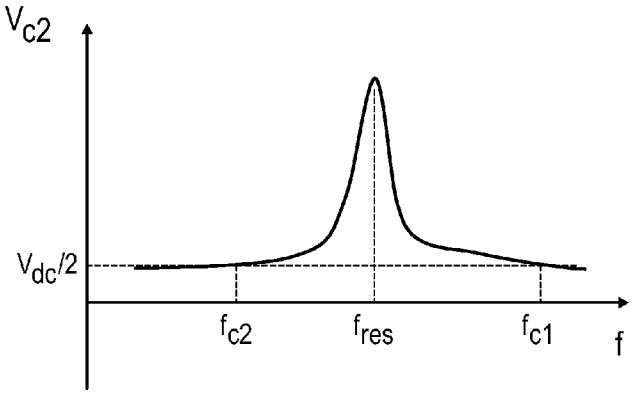
FIG. 4 is a graphical diagram showing an output voltage of the embodiment of FIG. 3 with respect to switching frequency, without the self-clamping circuit component.

The peak AC component of the voltage across capacitor C2 with respect to the switching frequency (f) without diode D1 is shown in FIG. 4. At switching frequencies fc1, fc2, the peak voltage across capacitor C2 is equal to one half of the voltage input from the DC power source Vdc, or in other words Vdc/2.

Figure 5:
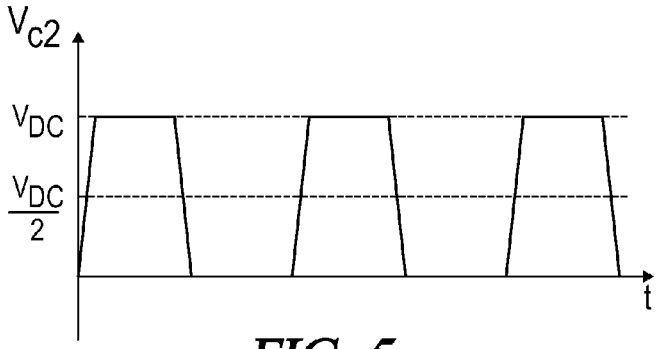
FIG. 5 is a graphical diagram showing an output voltage of the embodiment of FIG. 3 with respect to time, with the self-clamping circuit component enabled.

When the clamping circuit is enabled, or with regards to the embodiment of FIG. 3 when the diodes D1, D2 are conductive, the waveform for the output voltage across capacitor C2 is shown in FIG. 5. The peak clamped voltage across capacitor C2 is Vdc because diode D2 is arranged to conduct when the peak voltage across capacitor C2 reaches Vdc. The DC offset of the voltage across capacitor C2 is near Vdc/2. Therefore the moment when diode D1 is prepared to conduct is effectively whenever the AC component of the voltage across capacitor C2 reaches Vdc/2. By analyzing the output curve in FIG. 4, it may be understood that diode D1 therefore conducts between frequencies fc1 and fc2.

With the clamping circuit so provided, the output voltage curve for the filament heating circuit 52 varies with the switching frequency (f) as shown in FIG. 7. When the clamping circuit is enabled, or otherwise with reference to the embodiment of FIG. 3 when the diodes D1, D2 are conductive, the voltage across capacitor C2 effectively resembles a voltage source in the filament heating resonant tank. As a result, the only resonant components in the filament heating tank are the primary winding Tp of the filament heating transformer and the capacitor C1. The output curve of the resonant tank in the filament heating circuit 52 is curve 1 as shown in FIG. 7 with a resonant frequency of $$fres1=1/(2\Pi\sqrt{(L1\times C1)}),$$

where L1 is the inductance value for the primary winding Tp of the filament heating transformer T1. It may be understood that the resonant frequency (fres2) is greater than the resonant frequency (fres1) because the equivalent capacitance (Ceq) of capacitors C1, C2 is less than the capacitance of capacitor C1.

The preheat frequency (fpre) may in various embodiments generally be designed to be greater than either of the resonant frequencies (fres1, fres2) to ensure inductive mode switching of the switches Q1, Q2 in the half-bridge inverter configuration. Further, the preheat frequency (fpre) may be designed to be between frequencies fc1, fc2 to ensure that diode D1 is conductive during the preheat period, such that the preheat output is part of curve 1 as shown in FIG. 7, which has a "flat" output around the preheat frequency (fpre).

Figure 6:
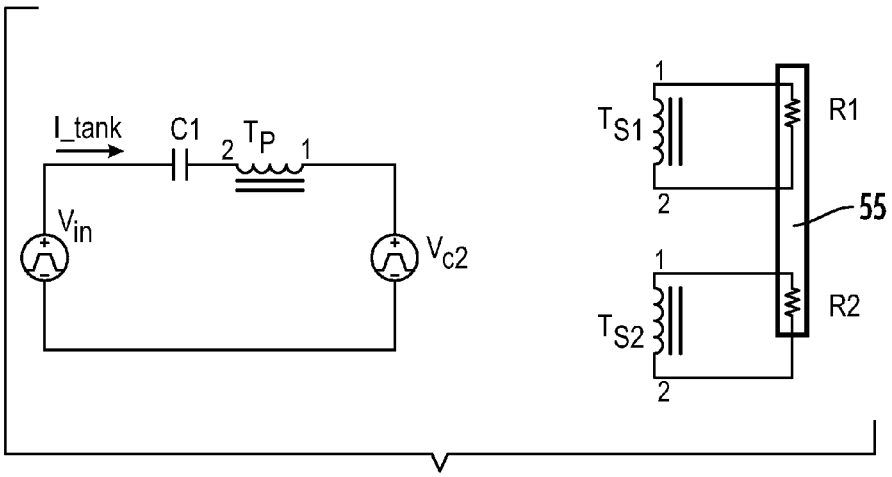
FIG. 6 is a circuit diagram showing an equivalent circuit to the embodiment of FIG. 3 when the clamping circuit is enabled.

When diode D1 is conducting, the voltage across capacitor C2 is fixed, and therefore appears as a voltage source which effectively produces a circuit as shown in FIG. 6 as an equivalent to the circuit of FIG. 3. In FIG. 6, the voltage Vin is the equivalent AC input voltage at the inverter output terminal 56 or, in other words, the node 56 between the switches Q1, Q2 in the half-bridge inverter 57. The phase angle of Vin is set as the reference 0 degree, and constitutes a square waveform having an amplitude Vdc/2.

Because the preheat frequency (fpre) is greater than the resonant frequency (fres2) the tank current I_tank is inductive. When the preheat frequency (fpre) is close enough to the resonant frequency (fres2) or otherwise when the operating frequency (f) approaches resonance, the phase angle of the tank current I_tank should be close to −90 degrees with reference to the voltage Vin. As a result the phase angle of the AC component of the voltage across capacitor C2 is close to 180 degrees with an amplitude of Vdc/2. The total input voltage of the tank is therefore effectively (Vin+Vc2), which is a quasi-square wave and has an amplitude of Vdc. This total input voltage is twice as large as the input voltage Vin when diode D1 is not conductive and functioning to clamp the voltage.

Because the preheat frequency (fpre) is much larger than the resonant frequency (fres1), the output of curve 1 in a certain range around the preheat frequency (fpre) is flat. Therefore the output voltage Vout of the tank is substantially insensitive, or "stable", with regards to preheat frequency variation and/or component variation. Even the transfer gain of this part of the curve is small because the preheat frequency (fpre) is significantly smaller than the resonant frequency (fres1), but with the assistance of a larger equivalent input voltage source (as compared to Vin normally when diode D1 is not clamping) a large output voltage Vout may still be obtained. As a result, a constant and effectively large filament heating voltage may be generated across the primary winding Tp of the filament heating transformer, the secondary windings Ts1, Ts2 of the filament heating transformer, and thereby the filaments R1, R2 of the lamp 55.

After preheating of the filaments R1, R2, the controller 12 may be programmed to sweep the switching frequency down to the steady-state frequency (fsteady) to ignite the lamp 55 and drive the lamp to steady-state operation. In the steady state, the frequency (fsteady) is lower than frequency (fc2) so the clamping circuit 26 is disabled. In the embodiment shown in FIG. 3, this is because diode D1 is no longer conductive where the AC component of the voltage across capacitor C2 is less than Vdc/2. The output voltage Vout for the filament heating circuit 52 shifts to curve 2 again. Because the steady state frequency (fsteady) is much lower than the resonant frequency (fres2), the output voltage Vout is very small as shown in FIG. 7. The filament heating voltage is therefore substantially reduced in steady state operation and little to no excess power may be dissipated in the lamp filaments.

Figure 9:
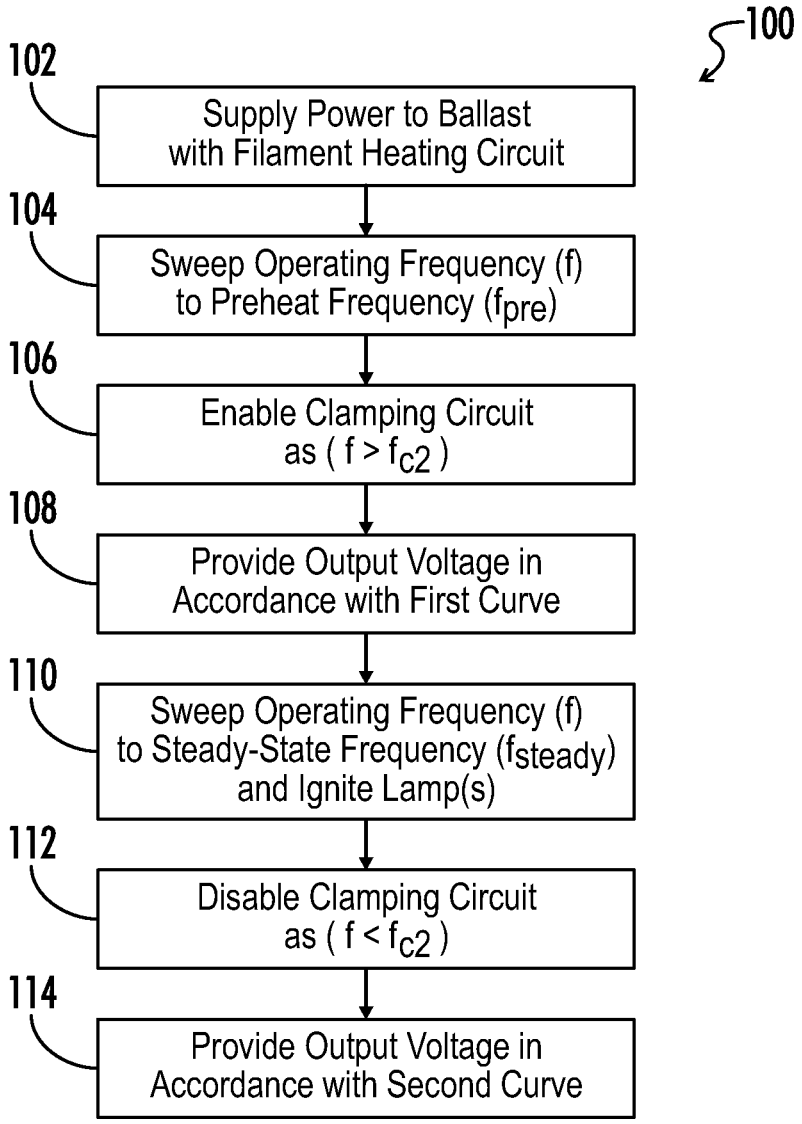
FIG. 9 is a flowchart showing a method of operation for various embodiments of a filament heating circuit of the present invention.

Operation of various embodiments of the filament heating circuit 52 in accordance with this description may be further shown with reference to FIG. 9. The method of operation 100 begins with power being initially supplied to an electronic ballast having the filament heating circuit 52 as described above (step 102).

The inverter driver, as integrated within or otherwise independent but typically as directed by control signals provided from controller 51, then enters a lamp filament preheat operating mode and sweeps the switching frequency of the switches Q1, Q2 in the half-bridge inverter up to a preheat frequency (fpre) (step 104).

As the switching frequency (f) exceeds a threshold frequency (fc2), the voltage across capacitor C2 in the filament heating circuit 52 exceeds a threshold value for the clamping circuit. The clamping circuit (e.g., conduction of the clamping elements D1, D2 as in the embodiment shown in FIG. 3) is then enabled (step 106).

With the voltage across capacitor C2 clamped, an output voltage for the filament heating circuit 52 is provided in accordance with a first curve (curve 1 as shown in FIG. 7) (step 108).

Once the lamp filaments have been properly heated, the controller 51 then sweeps the switching frequency of the switches Q1, Q2 down to ignite the lamp (at or near resonant frequency). After the lamp has been ignited the controller 51 further sweeps the switching frequency lower to enter a steady state operating mode and approach a steady state frequency (fsteady) (step 110).

As the switching frequency (f) sweeps below the threshold frequency (fc2), the voltage across capacitor C2 in the filament heating circuit 52 falls below the threshold value for the clamping circuit. The clamping circuit (e.g., conduction of the clamping elements D1, D2 as in the embodiment of FIG. 3) is then disabled (step 112).

With the voltage across capacitor C2 no longer clamped, an output voltage for the filament heating circuit 52 is provided in accordance with a second curve (curve 2 as shown in FIG. 7) (step 114). As a result, the filament voltage is effectively cut back to a steady state range wherein substantially no excess power will be dissipated in the filaments of the lighting source.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

The terms "switching element" and "switch" may be used interchangeably and may refer herein to at least: a variety of transistors as known in the art (including but not limited to FET, BJT, IGBT, IGFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Depending on the embodiment, certain acts, events, or functions of any of the algorithms described herein can be performed in a different sequence, can be added, merged, or left out altogether (e.g., not all described acts or events are necessary for the practice of the algorithm). Moreover, in certain embodiments, acts or events can be performed concurrently, e.g., through multi-threaded processing, interrupt processing, or multiple processors or processor cores or on other parallel architectures, rather than sequentially.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. An electronic ballast comprising:

an inverter circuit comprising a power supply having positive and negative output terminals, a controller, and a pair of switching elements coupled between the positive and negative terminals of the power supply, the switching elements responsive to control signals from the controller to oscillate at an operating frequency and to generate an output voltage at an inverter output terminal between the switching elements;

a main inverter tank comprising a resonant inductor and a resonant capacitor coupled in series between the inverter output terminal and the negative terminal of the power supply; and a filament heating circuit further comprising a primary winding of a filament heating transformer having a first end coupled to the resonant inductor and a second end coupled to a first capacitor, a second capacitor coupled between the first capacitor and the negative terminal of the power supply, and a clamping circuit coupled to the second capacitor and configured to, during a preheat mode of operation, clamp an amplitude of the voltage across the primary winding of the filament heating transformer to an amplitude of the input voltage from the power supply.

2. The ballast of claim 1, wherein the primary winding of the filament heating transformer is coupled on the first end to a node between the resonant inductor and the resonant capacitor.

3. The ballast of claim 2, wherein during the preheat mode of operation, the filament heating circuit has a first resonant capacitance equal to a capacitance value of the first capacitor, and a first resonant frequency associated with the first resonant capacitance, and during a normal mode of operation, the filament heating circuit has a second resonant capacitance equivalent to a combined capacitance value of the first and second capacitors coupled in series, and a second resonant frequency associated with the second resonant capacitance.

4. The ballast of claim 3, wherein the controller is configured to control the operating frequency of the switching elements during the preheat mode to a frequency greater than the first and second resonant frequencies of the filament heating circuit.

5. The ballast of claim 4, the clamping circuit further comprising a first diode coupled between the second capacitor and the positive terminal of the power supply.

6. The ballast of claim 5, wherein the first diode is configured to conduct when an AC component of the voltage across the second capacitor exceeds a portion of the input voltage from the power supply.

7. The ballast of claim 5, the clamping circuit further comprising a second diode coupled in parallel with the second capacitor and between the first diode and the negative terminal of the power supply.

8. The ballast of claim 7, wherein the second diode is configured to conduct when the peak voltage across the second capacitor is equal to the input voltage from the power supply.

9. A lamp filament heating circuit for an electronic ballast having an inverter comprising first and second switches arranged to oscillate at a switching frequency and a resonant tank coupled to an inverter output between the first and second switches, the filament heating circuit comprising:

a filament heating transformer having a primary winding electrically coupled on a first end to the resonant tank, and magnetically coupled to a plurality of secondary windings further coupled to output terminals of the ballast;

a first capacitor electrically coupled to a second end of the primary winding;

a second capacitor electrically coupled between the first capacitor and a negative voltage rail of the ballast; and a clamping circuit electrically coupled to the second capacitor, wherein the filament heating circuit in a first mode of operation is configured to generate an output voltage across the primary winding with respect to the switching frequency and in accordance with a first output curve, wherein the filament heating circuit in a second mode of operation is configured to generate an output voltage across the primary winding with respect to the switching frequency and in accordance with a second output curve, and wherein an effective output curve representing a combination of the first and second output curves for the filament heating circuit comprises a stable first output voltage for a preheat switching frequency and a stable second output voltage for a steady-state switching frequency.

10. The filament heating circuit of claim 9, the clamping circuit further comprising a first diode coupled between the second capacitor and a positive voltage rail of the ballast, wherein the first diode is configured to conduct when an AC component of the voltage across the second capacitor exceeds a portion of the output voltage from the inverter.

11. The filament heating circuit of claim 10, the preheat mode of operation further comprising conduction by the first diode, wherein the output voltage of the filament heating circuit during the preheat mode is clamped to the input voltage provided from the inverter, and the normal mode of operation further comprising a period of time where the first diode is not conductive, wherein the output voltage of the filament heating circuit during the normal mode does not exceed an output voltage from the inverter.

12. The filament heating circuit of claim 11, wherein the filament heating circuit is configured during the preheat mode of operation to generate the output voltage across the primary winding of the filament heating transformer based on resonant characteristics of the first capacitor and the primary winding, and an output voltage supplied by the inverter having a preheat frequency greater than the first and second resonant frequencies.

13. The filament heating circuit of claim 12, the clamping circuit further comprising a second diode coupled in parallel with the second capacitor and between the first diode and the negative rail of the ballast, wherein the second diode is configured to conduct when the peak voltage across the second capacitor is equal to an output voltage from the inverter.

14. The filament heating circuit of claim 13, the resonant tank comprising a resonant inductor and a resonant capacitor coupled in series between the inverter output and the negative voltage rail, wherein the primary winding of the filament heating transformer is coupled to a node between the resonant inductor and the resonant capacitor.

15. A method of heating lamp filaments coupled to an electronic ballast having a half-bridge switching circuit, a switch controller, a DC power supply, and a main resonant tank coupled between the switches in the half-bridge switching circuit, the method comprising the steps of:

providing a filament heating circuit having a filament heating resonant tank further coupled between a resonant capacitor and a resonant inductor in the main resonant tank, and further having a clamping circuit coupled to first and second voltage rails for the electronic ballast, controlling the switches in the half-bridge switching circuit during a preheat mode of operation to generate a voltage between the switches at a first frequency, activating the clamping circuit during the preheat mode to clamp an output voltage generated by the filament heating circuit to an amplitude of the voltage supplied from the DC power supply, controlling the switches during a normal mode of operation to generate a voltage between the switches at a second frequency, and deactivating the clamping circuit during the normal mode.

16. The method of claim 15, wherein the first frequency is greater than a resonant frequency for the filament heating resonant tank and the second frequency is less than the resonant frequency for the filament heating resonant tank.

17. The method of claim 16, the filament heating resonant tank comprising a first capacitor, a second capacitor and a primary winding of a filament heating transformer, the clamping circuit comprising one or more diodes coupled to the second capacitor, wherein the step of activating the clamping circuit during the preheat mode comprises arranging the one or more diodes to conduct during the preheat mode and clamp the voltage across the second capacitor, wherein the resonant frequency for the filament heating resonant tank is determined based on the resonant characteristics of the first capacitor and the primary winding.

18. The method of claim 17, wherein clamping the voltage across the second capacitor further comprises inducing a positive DC voltage offset across the second capacitor.

19. The method of claim 18, further comprising controlling the switches during the normal mode to generate a steady-state voltage having an amplitude less than the amplitude of the voltage supplied from the DC power supply.

20. The method of claim 19, wherein the step of deactivating of switches during the normal mode comprises reducing the output voltage of the resonant tank below a minimum voltage for the one or more diodes to conduct, wherein the resonant frequency for the filament heating resonant tank is determined based on the resonant characteristics of the first capacitor, the second capacitor and the primary winding.

* * * * *